US006286701B1

(12) United States Patent
Umiker

(10) Patent No.: US 6,286,701 B1
(45) Date of Patent: Sep. 11, 2001

(54) CONTAINER, IN PARTICULAR FOR TRANSPORTING FRUITS AND VEGETABLES

(75) Inventor: Hans Umiker, Egg (CH)

(73) Assignee: Schoeller Plast SA, Romont (CH)

( * ) Notice: Subject to any disclaimer, the term of this patent is extended or adjusted under 35 U.S.C. 154(b) by 0 days.

(21) Appl. No.: 09/367,020

(22) PCT Filed: Feb. 6, 1998

(86) PCT No.: PCT/EP98/00673

§ 371 Date: Feb. 1, 2000

§ 102(e) Date: Feb. 1, 2000

(87) PCT Pub. No.: WO98/34838

PCT Pub. Date: Aug. 13, 1998

(51) Int. Cl.[7] ..... B65D 6/12
(52) U.S. Cl. ..... 220/6; 220/1.5; 220/7
(58) Field of Search ..... 220/6, 7, 1.5, 338, 220/340

(56) References Cited

U.S. PATENT DOCUMENTS

| | | | | |
|---|---|---|---|---|
| 4,320,845 | * | 3/1982 | Waller | 220/7 X |
| 4,917,255 | * | 4/1990 | Foy et al. | 220/6 |
| 5,467,885 | * | 11/1995 | Blinstrub | 220/6 |
| 5,797,508 | * | 8/1998 | Loftus et al. | 220/6 |
| 5,829,617 | * | 11/1998 | Umiker | 220/6 |
| 6,098,827 | * | 8/2000 | Overholt et al. | 220/6 |

* cited by examiner

*Primary Examiner*—Steven Pollard
(74) *Attorney, Agent, or Firm*—Sheridan Ross PC

(57) ABSTRACT

A container, in particular for transporting fruit and vegetables, has a bottom and four side walls that can be folded onto the bottom. The side walls are connected by hinges to the bottom and the hinges are designed as plug-in connecting elements, so that the side walls may be plugged with their hinges arranged at their lower edge into corresponding openings in the bottom of the container and locked therein by locking elements.

2 Claims, 15 Drawing Sheets

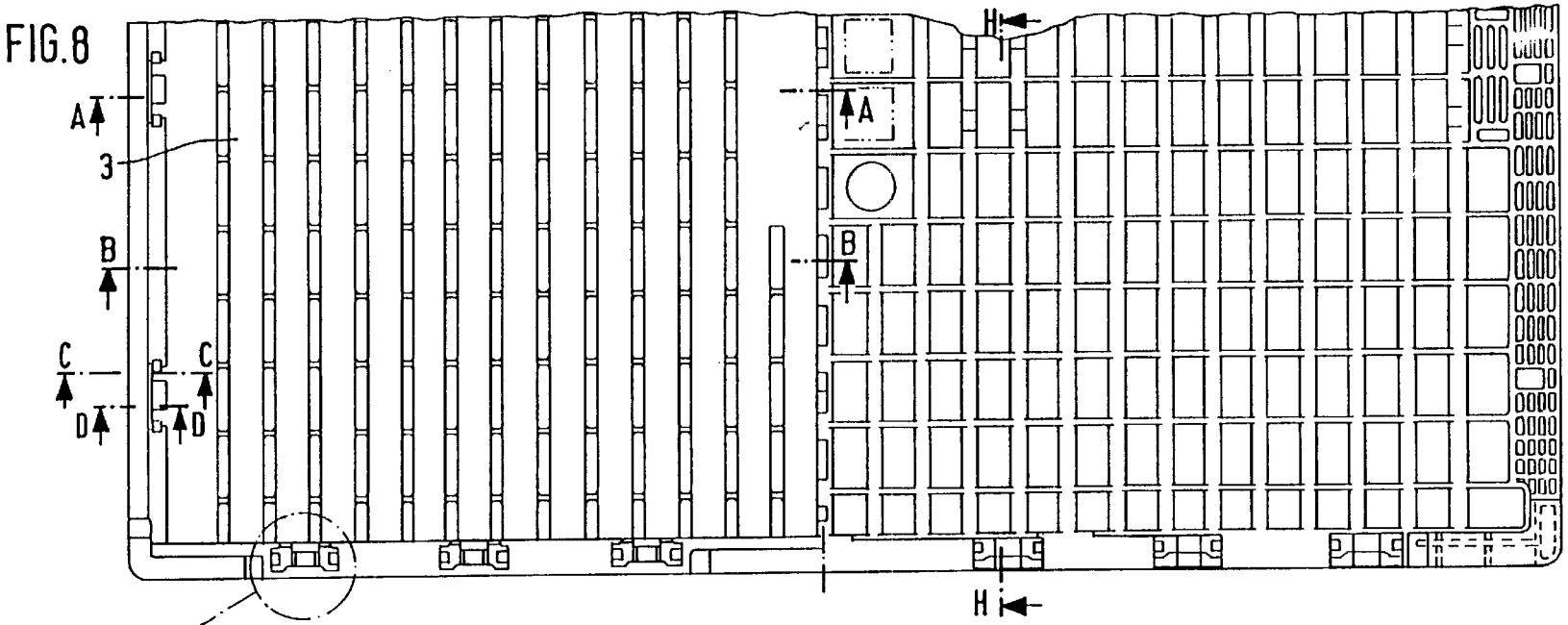
FIG.8
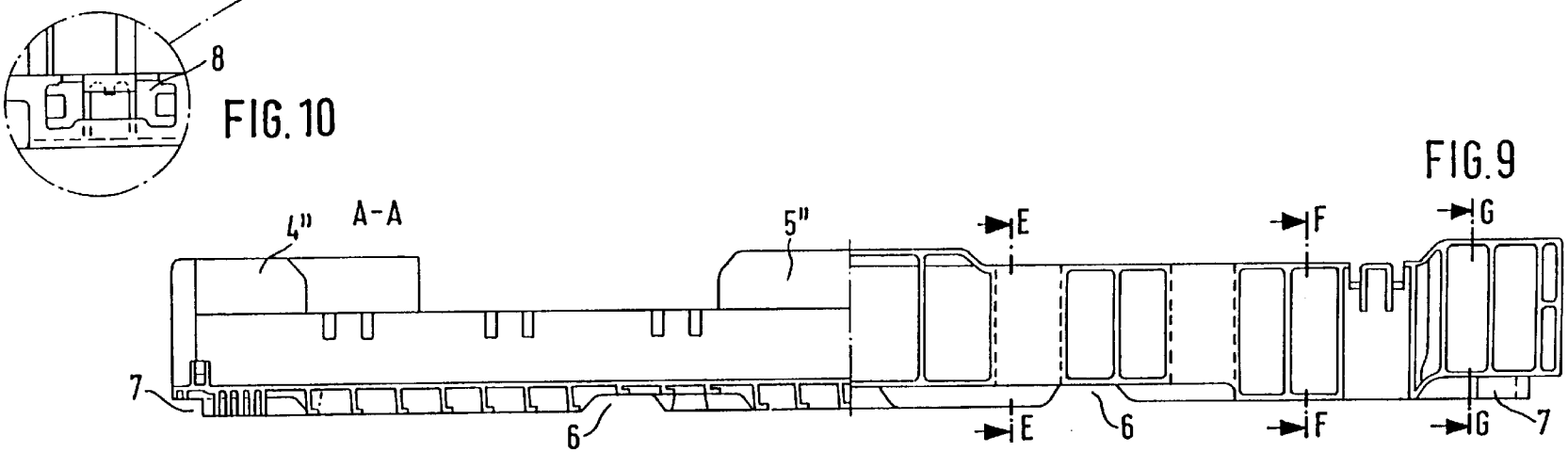
FIG.9
FIG.10

FIG. 11
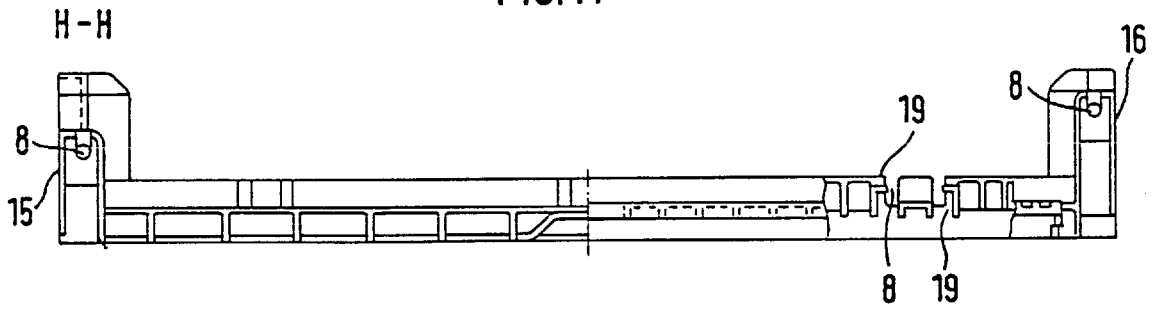
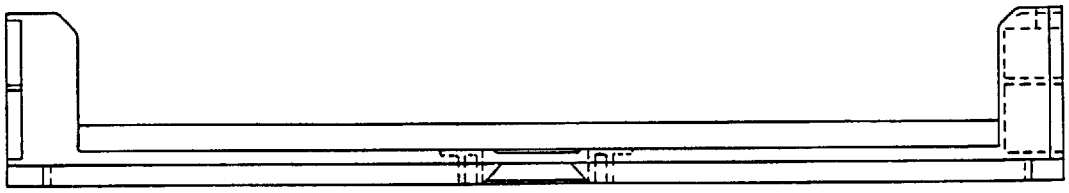
FIG. 13

CONTAINER, IN PARTICULAR FOR TRANSPORTING FRUITS AND VEGETABLES

FIELD OF THE INVENTION

The invention concerns a container which is made of plastic and has been designed especially for the transportation of fruit and vegetables and comprises a container base and four side walls which fold onto it.

BACKGROUND OF THE INVENTION

Containers of this nature are known where the side walls are either connected to the base of the container by way of joint hinges which are allocated at intervals across the circumference of the base or by way of one-piece integral hinges. In this way, after the container has been used, the side walls can be folded inwards towards the base, so that the empty container requires a minimum of space for the return journey and the storage. Compared with joint hinges, the integral hinges have the advantage that they can be easily cleaned and are also simple to manufacture. The joint hinges have the advantage that the side wails can be removed from the base, thus, unlike the one-piece integral hinge, enabling an exchange in the event of damage.

SUMMARY OF THE PRESENT INVENTION

The task of the invention is to create a container out of plastic which enables a simple assembly of the side walls to the container base. The handling of the container should be furthermore enabled, especially during the collapsing and erecting procedure of the side walls and the container should guarantee stability when in the transportation position and when holding goods. The folding up of the container should also be accomplished quickly and easily without any great effort.

This task has been solved by the characteristics included in the typical part of claim 1, whereby practical further developments of the characteristics included in the subclaims are identified.

In accordance with the invention, the side walls are connected to the base by way of joint hinges, whereby the hinges are formed in the style of lockable connectors in which the formed hinge elements on the lower edge of the side walls are inserted into the corresponding insert openings on the sides of the base and can be locked behind latches or similar locking elements. It is thus practical that the locking elements, in connection with the hinge elements on the side walls, form the hinges or a part of the hinges. For functional reasons, the side walls are mounted vertically from above with the hinge elements set into the openings on the base, in doing so, the latches, which are preferably arranged opposite within the opening, move away and then catch behind the hinge pin, so that the side walls are firmly anchored to the base. The removal of the side walls is of course possible for practical reasons, whereby the latches are separately pushed backwards, if necessary with a tool. To improve the stability it is thus practical that at least one latch protrudes laterally from the hinge pin and acts like a shoulder with a stop formed within the insert opening, so that in the opened up position of the wall, an additional mechanical blockade is formed as a result of the immediate arrangement of the latch to the stop shoulder. This means that the folding container feels very stable when handling during transportation. A simple hinge design and structure arises as the latches and/or stop springs, which catch behind the hinge pin and lock it, are at the same time a part of the hinge support.

It is particularly practical for the collapsing that running flanges or beaded edges are provided on the base, which are arranged stepped corresponding to the thickness of the side wall, so that the side walls can be folded on top of each other. For practical purposes, the insert openings for the intake of the hinges are arranged in these edge flanges or beaded edges. These beaded edges also serve as stop shoulders for the side walls in their opened up state, for which they are provided with troughs in particular areas, against which the side walls, in an opened up state, are aligned by way of corresponding or complementary troughs, thus increasing the stability of the container in the opened up state. It is thus practical if projections are provided in the area of the edge flanges or the beaded edges as well as on the upper edge of the side walls, especially in the comer areas and also in the middle of the longer walls, which offers stacking advantages and, in connection with correspondingly formed base stacking slots, also prevents any other types of crate or container from being used in the stack. It is thus functional if the stop troughs are arranged/allocated in the edge flanges or beaded edges of the base in the area of these projections.

It is furthermore advantageous that the side walls and the base are formed by sectioned cross members which are allocated at intervals and are formed in such a way that the inside of the container has an even, smooth wall surface, however the outside of the container has a ribbed structure.

Locking elements are provided on at least two of the opposing side walls for the transportation of the container in its folded position. These elements can be unlocked by a simple pressing action and are especially situated in the two upper corner areas of the short side walls, which in a locking position catch in the respective locking shoulders of the other side walls and are as such arranged/formed so that the first inwardly folding side walls will fold inwards simultaneously when the locking elements are released, therefore requiring only one operation for the unlocking and the inward folding of the side walls. For functional purposes, these locking elements are formed in the style of handle elements with a hook-type locking ledge whereby the handle element is hinged for practical reasons at two points relating to the side walls, so that these joint points tilt and a release of the locking is ensured when the handle element is pressed. When the handle element is pressed, the corresponding side wall also folds in towards the base of the container at the same time as the locking is released.

BRIEF DESCRIPTION OF THE FIGURES

Implementation examples of the invention are described in the following by way of illustrations. Thereby illustrating FIG. 1 a view of the long side of the container, FIG. 2 a view of the short side of the container, FIG. 3 a plan view of the base, the left half illustrates a plan view from above and the right half a view from below, FIG. 4 the container in a folded position, FIG. 5 an enlarged detailed view of the long side wall to explain the section structure, FIG. 6 an individual study of a long side wall with a front-side view and plan view, FIG. 7 longitudinal section of the cutting plane portrayed in FIG. 6, FIG. 8 a partial view of the base, FIG. 9 a side view of the base, FIG. 10 a enlarged detail of the hinge slot from FIG. 8, FIG. 11 a cutaway side view of the base, FIG. 12 a detail of the base and side wall to explain an enlarged representation of the hinge, FIG. 13 a side view of the base, FIG. 14 a detailed view of the folding mechanism of the short side walls, FIG. 15 a section through a base-side beaded edge to explain the insert opening for the hinge elements, FIG. 16 detailed views for the accommodation of the long side walls, FIG. 17 a detailed view of the container to represent the collapsed position of the long side wall and the short side wall on the side of the container, FIG. 18 several sections of a side wall in the folded position, FIG. 19 the same views as in FIG. 18 in a fully collapsed position to represent the interlocking of these side walls, FIG. 20 a detailed view of the upper area of a short side wall, FIG. 21 a section in accordance with the B—B planes from FIG. 20, FIG. 22 a longitudinal section of the C—C plane from FIG. 20.

DETAILED DESCRIPTION OF PREFERRED EMBODIMENTS

Figure 1:
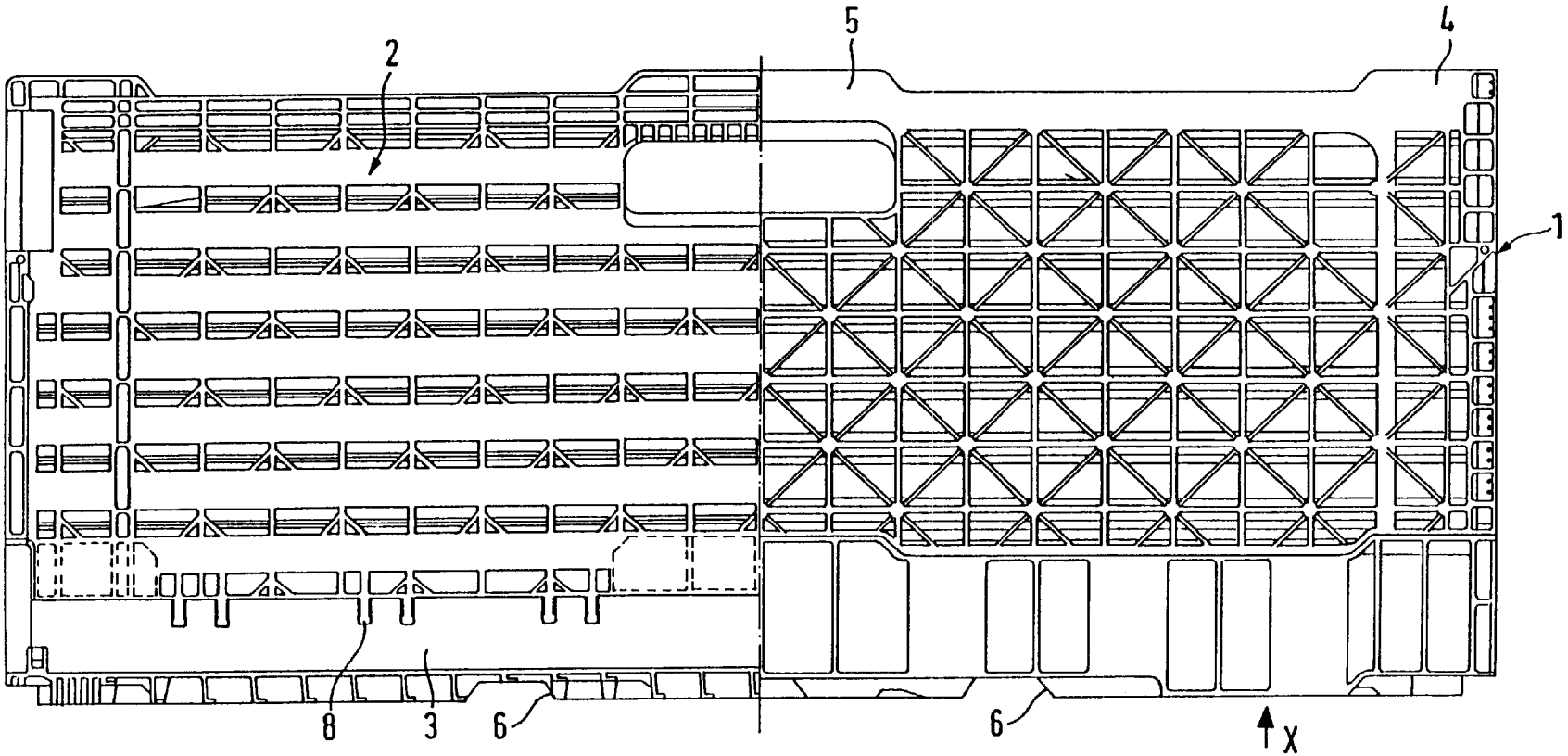

The plastic container represented in FIGS. 1 to 4 encompasses two short side walls 1 and two long side walls 2, which are manufactured separately from the base 3 and can be assembled onto the container base 3 by way of lockable instant connectors, whereby joint hinges are formed when they are put together, around which the side walls 1 and 2 can collapse towards the container base 3. This collapsed position can be seen in FIG. 4, whereby here the two short side walls 1 fold onto the base first of all, after which the folding of the long side walls 2 takes place, which fold on top of each other in accordance with FIG. 4. The container side walls 1 and 2 have projections 4 in the style of shoulders on their upper edge in the container corners, whereby corresponding projections or shoulders 5 are also provided on the two long side walls 2 in the middle area, which can clearly be seen in the FIGS. 1 and 2. In order to enable a staggered stacking of the folding container, corresponding stacking slots are provided on the underside of the base 3 which extend across the length and a stacking slot 7 in the direction of the length, which again can be seen in the FIGS. 1 and 2. While doing so, the stacking slots 6, which run parallel to both of the short side walls, are formed throughout, whereas the centre formed stacking slot 7, which runs parallel to the long side walls 1 is only partially formed, as can be especially seen from the right half of FIG. 3 which illustrates the view of the base from below. The troughs of the stacking slot 7 are evident in the areas 7*a* and 7*b*, on the edge and in the middle and are in line with the projections 4 and 5 on the upper edge of the side walls, as these move into the stacking slots 6 and 7 of the above container when they are staggered stacked. The design of the stacking slot 7 as only a partial stacking slot has the advantage that the rib structure in the base and the side walls (as described in more detail in the following) must only be reduced thickness-wise in certain part areas, which is an advantage for the stability of the container. Evident are the stacking slots 6 and 7 which are formed upwards by troughs within the base, so that the underside of the base stays level, which is advantageous for the stacking and the trouble-free transportation of the container on conveyor belts.

Troughs 8, which described in more detail in the following, can be seen in the right representation of FIG. 3, in which the joint hinges of the side walls are inserted from the upper side of the base. These troughs are arranged at intervals from one another, whereby in the represented implementation example, each long side wall 2 is provided with six hinge troughs 8 on the base. These hinge troughs 8 can be seen in the engagement position with the corresponding hinge elements of the side walls, which is also evident in the left representations of FIGS. 1 and 2.

Figure 5:
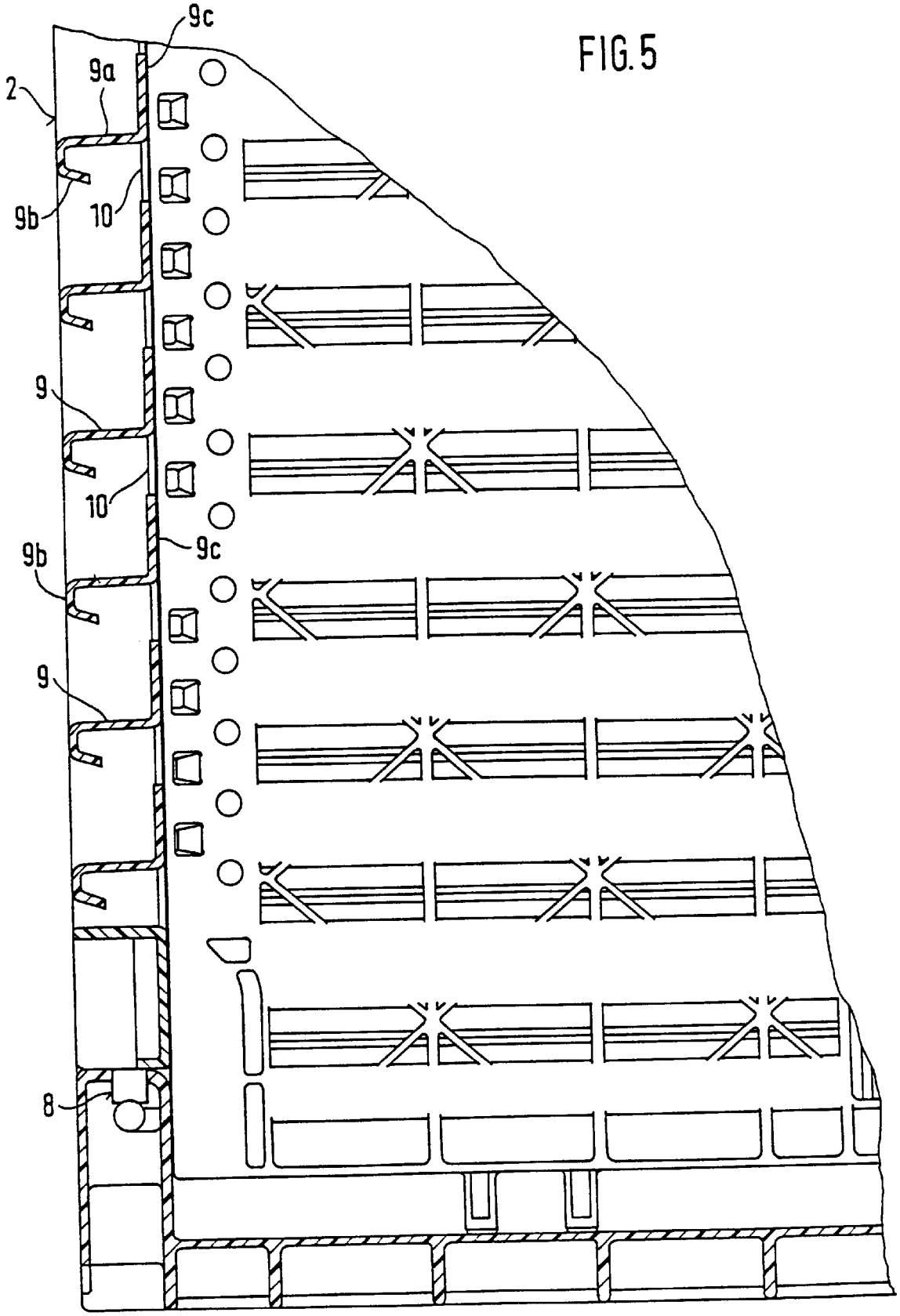

In the represented implementation example, the side walls 1 and 2 as well as the base are formed in a sectioned structure, which leads to level and smooth interior wall and base surfaces, so that there are no ribs on the inner side of the container, which is advantageous for the careful transportation of goods in the folding container, especially fruit and vegetables. This sectioned structure can be seen in more detail in FIG. 2, left representation for the long side wall 2, whereby FIG. 5 illustrates an enlarged representation to explain the sectioned structure of the surfaces of the wall and base. It is evident that the wall and base are arranged to each other with a minimum spacing, here formed as S or L-style rib sections 9, whereby the wall or base thickness is formed by way of a level cross member 9*a*, the outside by way of a curved cross member 9*b* in the style of a hook and the interior wall and base surfaces by way of a level cross member area 9*c*. The empty space between neighboring side sections is indicated with 10. This is especially calculated in such a way to enable a ventilation of the goods within the container, especially when stacked on a pallet, but also so that the goods being transported within the container cannot fall out or be picked out. The outside of the side walls as well as the lower base surface of the base 3 is restricted by the rib-style cross member area 9*b*, whereas the wider formed cross member area 9*c* restricts the internal wall surfaces as well as the base surface. This sectioned structure results in a lighter weighted, however incredibly stable base and side wall surface construction. This stability-increasing structure of the container is not weakened by the allocation of the above-described stacking slots 6 and 7, as the generally arranged stacking slots 6 extend the length of the "S" rib section 9 and the stacking nut 7 is only partially formed, therefore only a part of the "S" rib section 9 must be weakened in thickness for the forming of the stacking slot, especially in the middle and edge areas. In this way the sectioned structure of the base and the stacking troughs complement one another advantageously.

Figure 6:
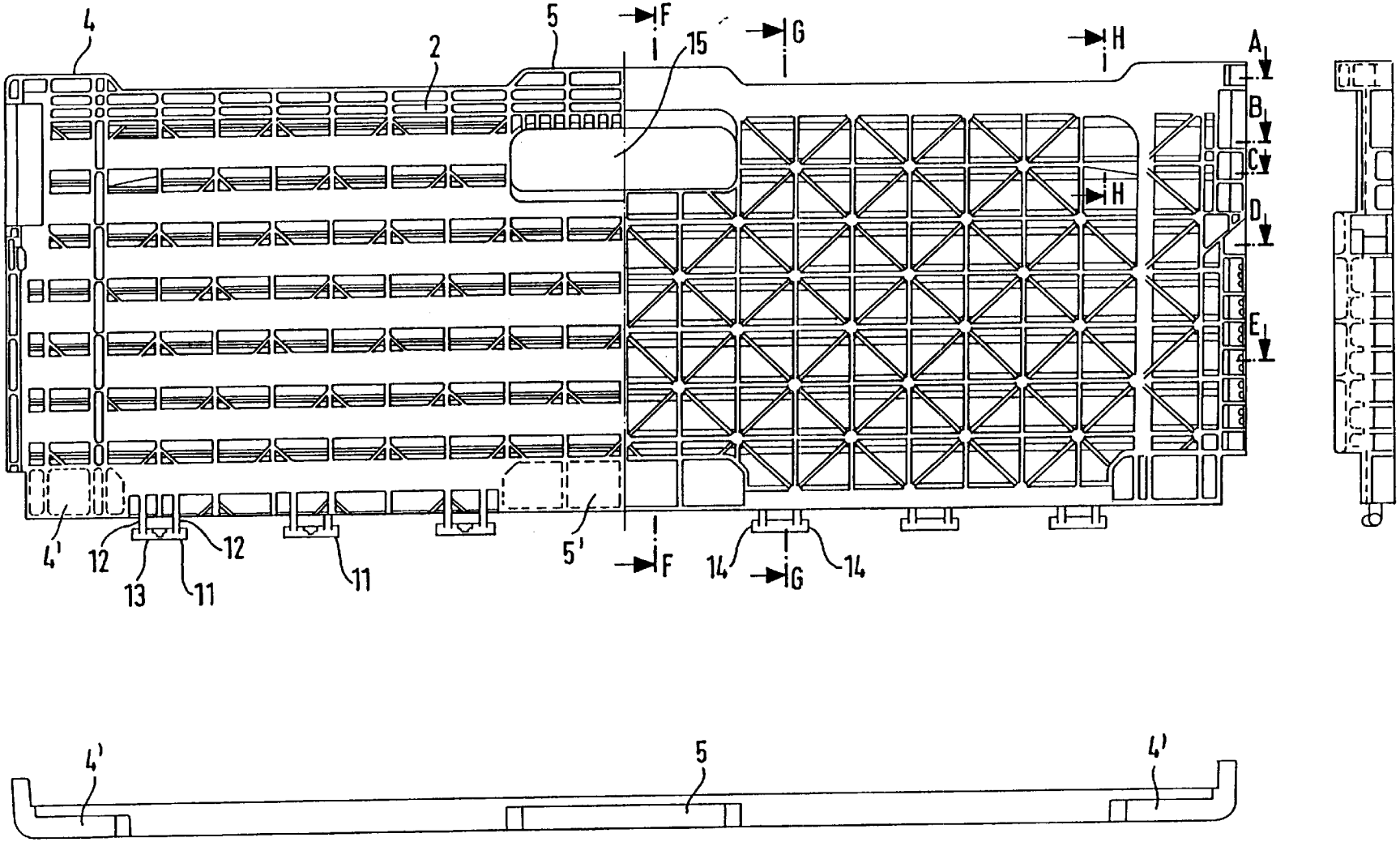
Figure 7:
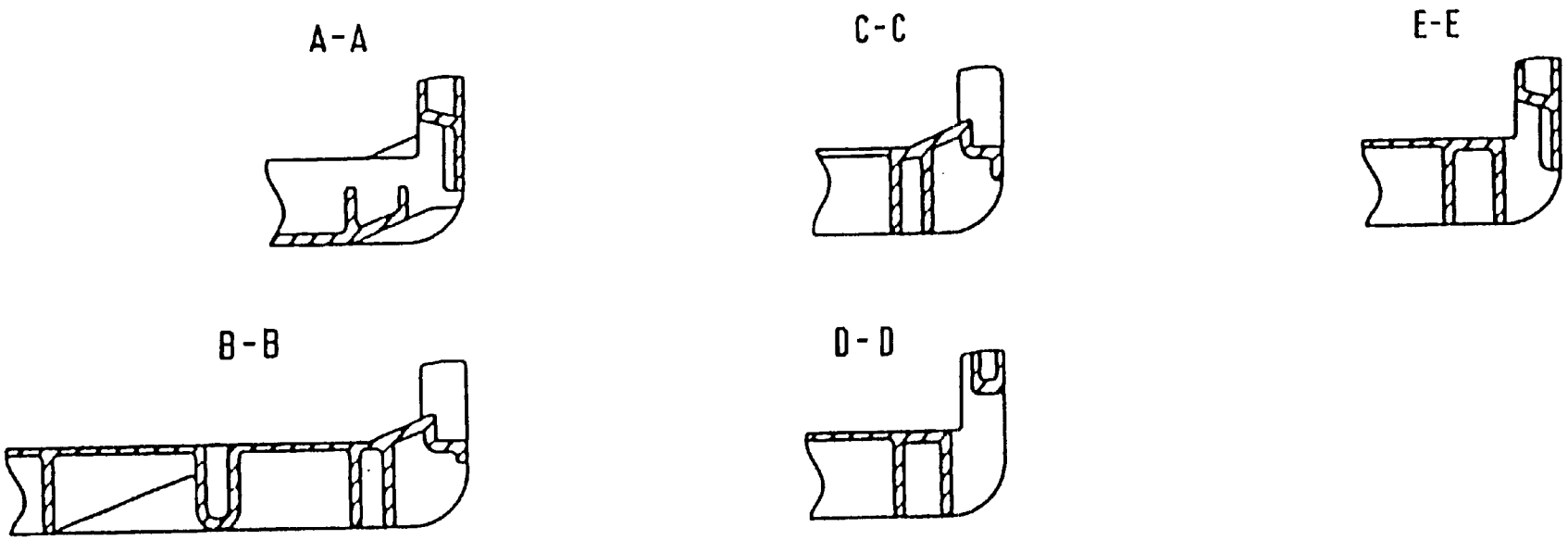

FIG. 6 shows an individual study of a long side wall 2 with a lateral front view on the right and a plan view of this side wall underneath for information purposes. The side wall 2 possesses on its base with base 3 connectable edge hinge elements 11, and in the represented implementation example a total of six hinge elements 11, which are arranged at intervals across the long side on the lower edge. In the represented implementation example the hinge element 11 consists of two cross members 12 which protrude downwards and a one-piece formed hinge pin 13 running diagonally to this. The hinge pin 13 bears out laterally with two hinge shoulders or appendices 14. The hinge elements 11 serve for the engagement in the corresponding hinge troughs in the base 3, which is described in more detail in the following. FIG. 7 illustrates various cross-section views from FIG. 6 to explain the long side wall.

FIG. 6 also shows a hand grip 15 which is formed through a trough in the long side wall.

Furthermore, from the side wall representation in FIG. 6, external troughs 4' and 5' are evident on the lower edge of the side wall 2 which essentially correspond in shape to the projections 4 and 5 and are especially complementary to the projections 4" and 5" on the base 3 of the container (FIG. 10). The projections 4" and 5" are aligned with the projections 4 and 5 on the side wall and serve, combined with the stacking troughs 6 and 7, also for staggered stacking when the side walls are folded. As is portrayed in the right representation of FIG. 1, the troughs 4' and 5' in the side walls essentially serve for the engagement with the projections 4" and 5" to the base 3 in the vertical opened position of the long side walls.

The hinge troughs 8 for the acceptance of the hinge elements 11 are incorporated in the lateral edge flanges of the base, which are formed with the base as a one-piece. One should refer to FIG. 11 for this, which illustrates the container base in various sectional views. As one can see from the right representation of FIG. 3, both lateral edge flanges, which hereby serve to accommodate the two long side walls, are given the reference characters 15 and 16 and have upper hinge troughs 8 which are also open as far as the base for the purpose of tool moulding. The edge flanges 15 and 16 are formed at varying heights, in order to enable the folding on top of one another of the two opposing long side walls corresponding to the representation in FIG. 4. The height of the edge flange 15 is hereby calculated in such a way that the snapped shut long side wall in the collapsed position reaches across the immediate pulled down shorter side wall which isn't visible in FIG. 11, whereas the height of the lateral edge flange 16 is calculated somewhat higher than the thickness of the long side wall so that the right long side wall lies across the left long side wall in the collapsed position. This means that the height of the edge flanges 15 and 16 are adjusted in steps to the thickness of the foldable side walls, in order to ensure the lowest possible height of the container when it is folded down for the return transportation and empty storage. One can also see from FIG. 11, especially from the right representation, the hinge slots 8 for the accommodation of the shorter side wall. As illustrated in the representation in FIG. 11, three hinge slots 8 are provided on both sides for the acceptance of a shorter side wall, whereby each short side wall is equipped on the lower edge with the appropriate hinge elements 11 for the long side wall analogous to the representation in FIG. 6, which protrude downwards across the lower edge and are snapped shut in the hinge slots 8.

Figure 12:
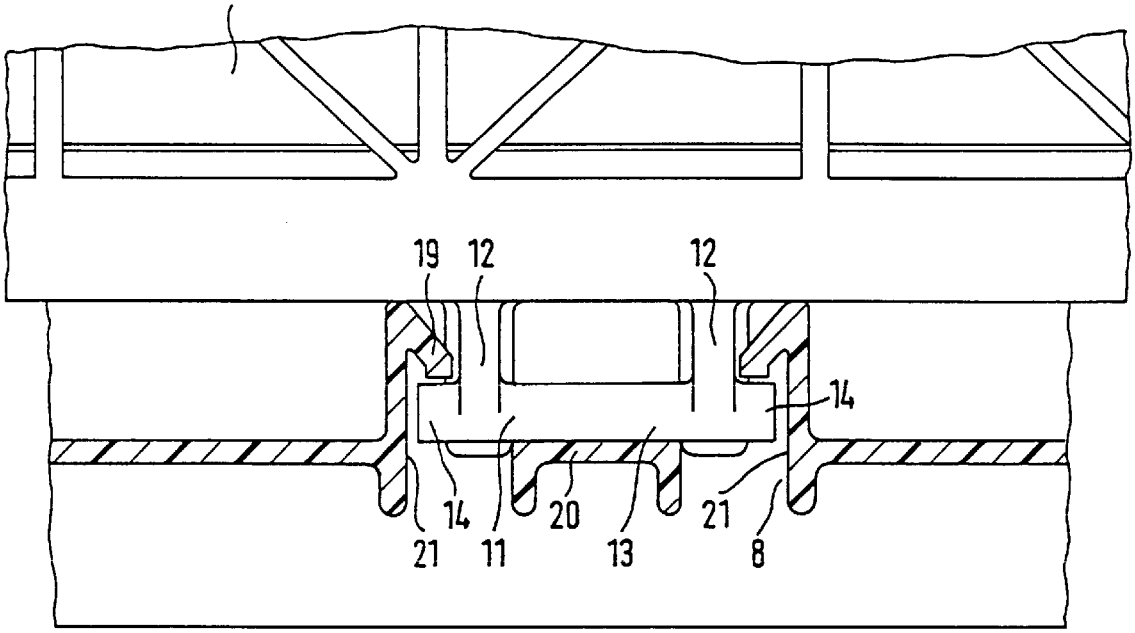

FIG. 12 shows an assembly position in which a hinge element 11 is engaged in the appropriate slot 8 in the base of the container and relates to the short side wall 1. FIG. 13 shows a side view of the base which is evident in FIG. 8.

Figure 14:
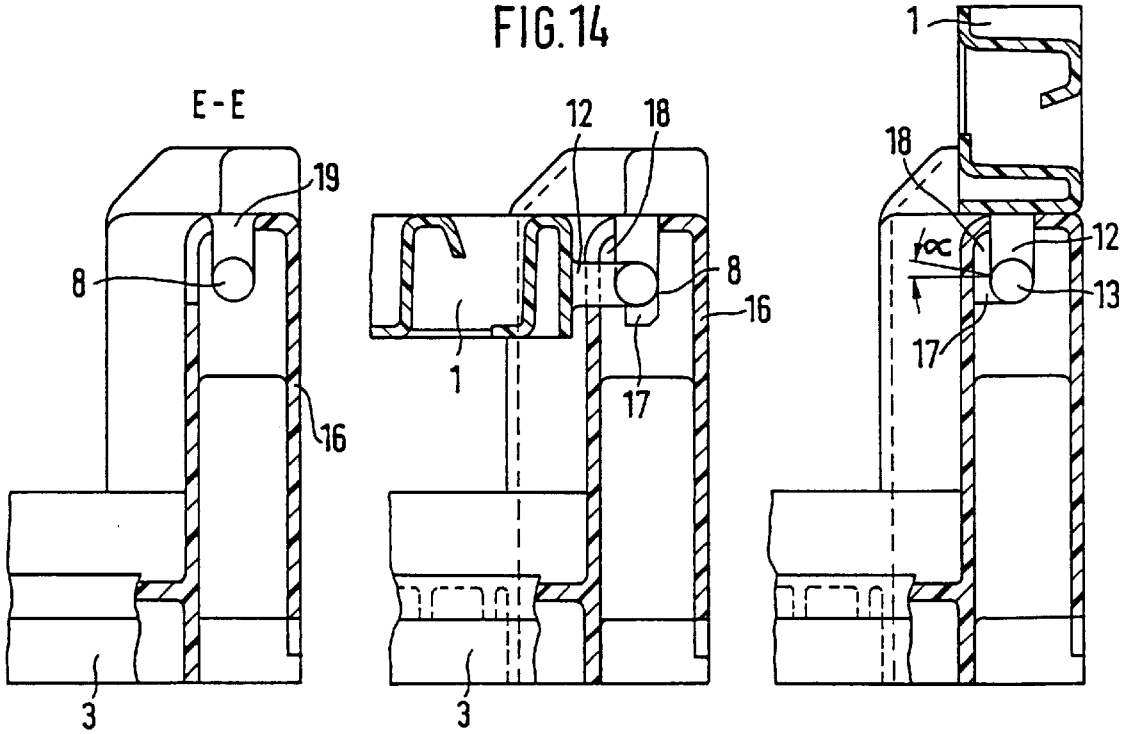
Figure 15:
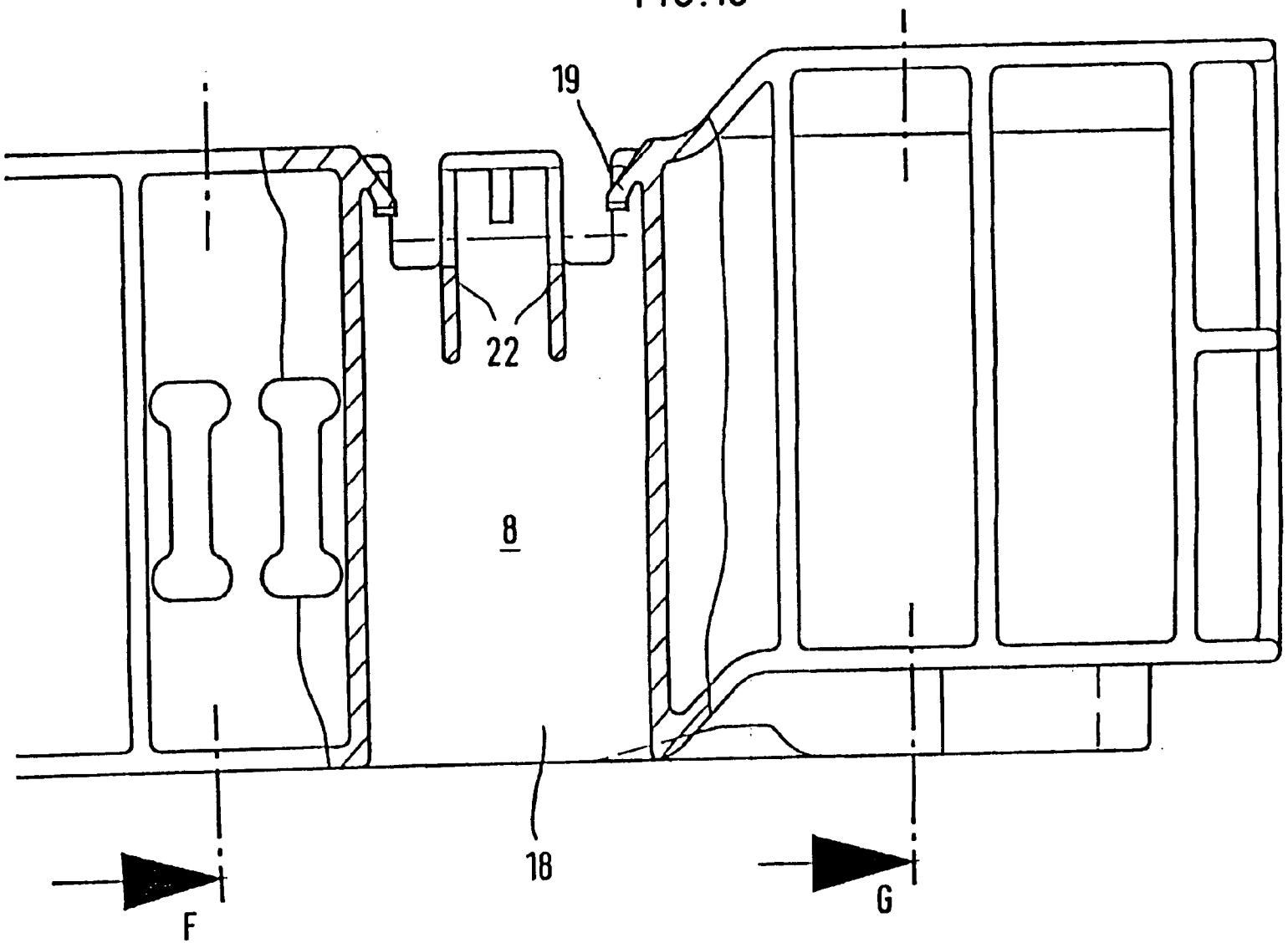
Figure 16:
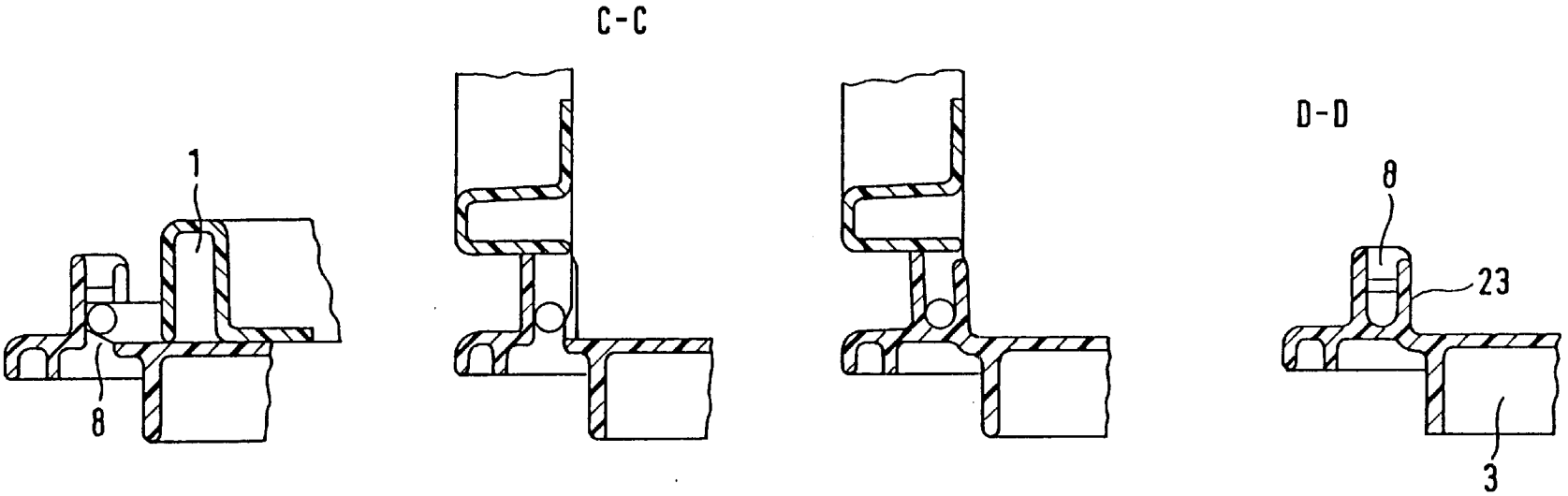

The assembly of the attachable side walls is explained in detail in FIGS. 14 to 16, the enlarged sectional representations are evident in the FIGS. 8 and 9. FIGS. 14 and 16 show the edge flange of the base 3 for the acceptance of the above-lying long side wall in the folded position, whereby the right representation in FIG. 14 shows the assembly position in which the long side wall 1 in a vertical position is pressed from above into the hinge slot 8 with the hinge pin 13. As is evident from the two right-hand representations in FIG. 14, the hinge pin 13 is provided with a lateral appendix 17 which serves as a stop. FIG. 12 shows that the hinge trough 8 has two opposite arranged and inwardly protruding latches or stop springs 19, which for practical reasons are formed as a one-piece with the base 3. When the long side walls are pressed from above through the hinge pin 13 or the lateral appendixes 14, these stop springs 19 are encroached upon and, in the engaged position of the long side walls, ensure that the walls do not pull out. The position in FIG. 12 shows the hinge element 11 fixed by way of latches to a fixed part 20 from the base plate to which the joint pin 13 is attached. Refer also to FIG. 15 for this. The stop springs 19 in connection with the counter parts 20 and 22 and the snapped shut hinge pin 13 behind the stop springs form a part of the joint hinge with which the side walls can be collapsed towards the base or can be folded upwards to the vertical position.

The centre representation of FIG. 14 hereby shows the folded down position for the return transportation of the container when empty with a reduced height, whereas the right representation shows the opened up position of the container for the goods to be transported.

In the opened up position of the long side wall 1, in accordance with the right representation, the latch 17 is swivelled 90° and grasps a stop shoulder 18 formed in the beaded edge 16. The stop shoulder 18 in connection with the latch 17 works as a mechanical block, so that the long side wall 1 is established in the opened up position and therefore cannot swing any further outwards. Due to the stop springs 19, during the handling of the container the side wall cannot be pulled out of the hinge slot 8. It can only be removed if the latches 19 are bent back separately. In the opened up position therefore the long side walls are on the one hand held by the previously described mechanical block using the stop shoulder 18 and the stop appendix 17, whereby this mechanical block further aided by the fact that the stop shoulder proceeds through an angle a which is indicated in the right representation in FIG. 14. This ensures a firm locking, so that the long side wall sits firmly within the base in the opened up position—so there is no "soft feeling" when the container is being handled. From this point of view, the mechanical block with the latch connection works together with the stop springs.

It is furthermore evident from FIG. 12 that the joint appendixes 14 have a lateral clearance to the walls 21 of the hinge trough in the base plate, whereby for a tolerance compensation it is ensured that also tolerance-related deviating hinge elements can be inserted in the hinge trough. The latches 19 are also shown in detail in FIG. 16 and this also shows that the hinge trough 8 is open all the way down which serves purely for tool moulding purposes during the manufacture of the container or of the base plate. The latches 19 are essentially evident in FIG. 14. In FIG. 15, the support for the joint pin is, so to speak, restricted by the two stop hooks 19 and the upper edge of the two cross members 22. This means that in the inserted hinge pin 13 in the hinge trough, the support is maintained by the stop hooks 19 and the upper edges of the cross member walls 22 when the long side wall is folded down.

FIG. 16 shows the slot of the short side wall 1 in the corresponding hinge slot 8, whereby the side wall is established in the vertical position also here so that the hinge pins grasp the stop springs. The two middle representations in FIG. 16 show the long side wall in a vertical opened position, whereby only the hinge trough 8 is evident in the right representation, which is formed in the lateral edge flange 23 of the base plate 3.

Figure 17:
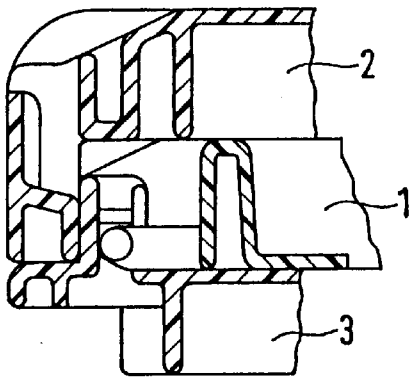

FIG. 17 shows a representation with the short side wall 1 in the collapsed position and the long side wall folded on top of it. The height of the transport container in the collapsed position of the side walls is dependent on the base thickness, the thickness of the short side wall 2, because, as is described in more detail in the following, the short side walls interlock with one another and the thickness of the two above long side walls 2.

Figure 18:
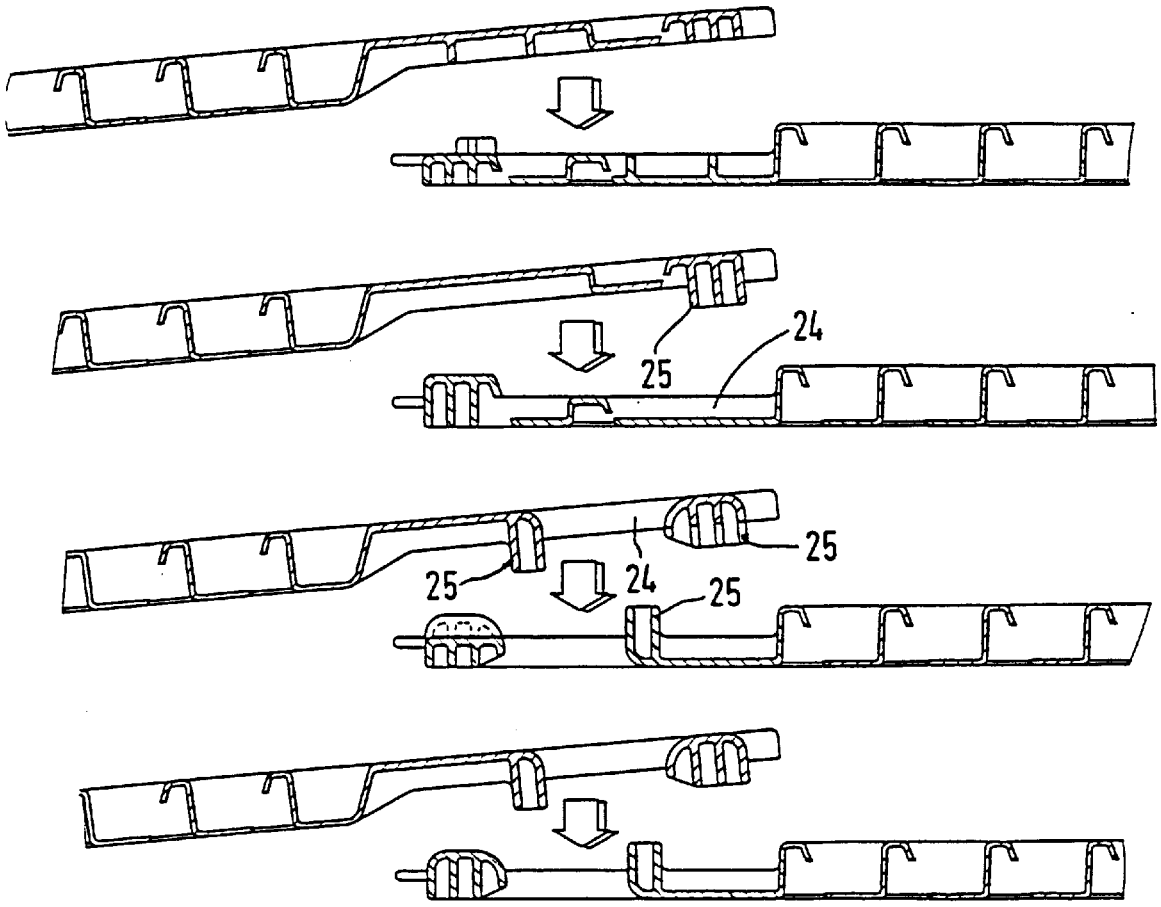
Figure 19:
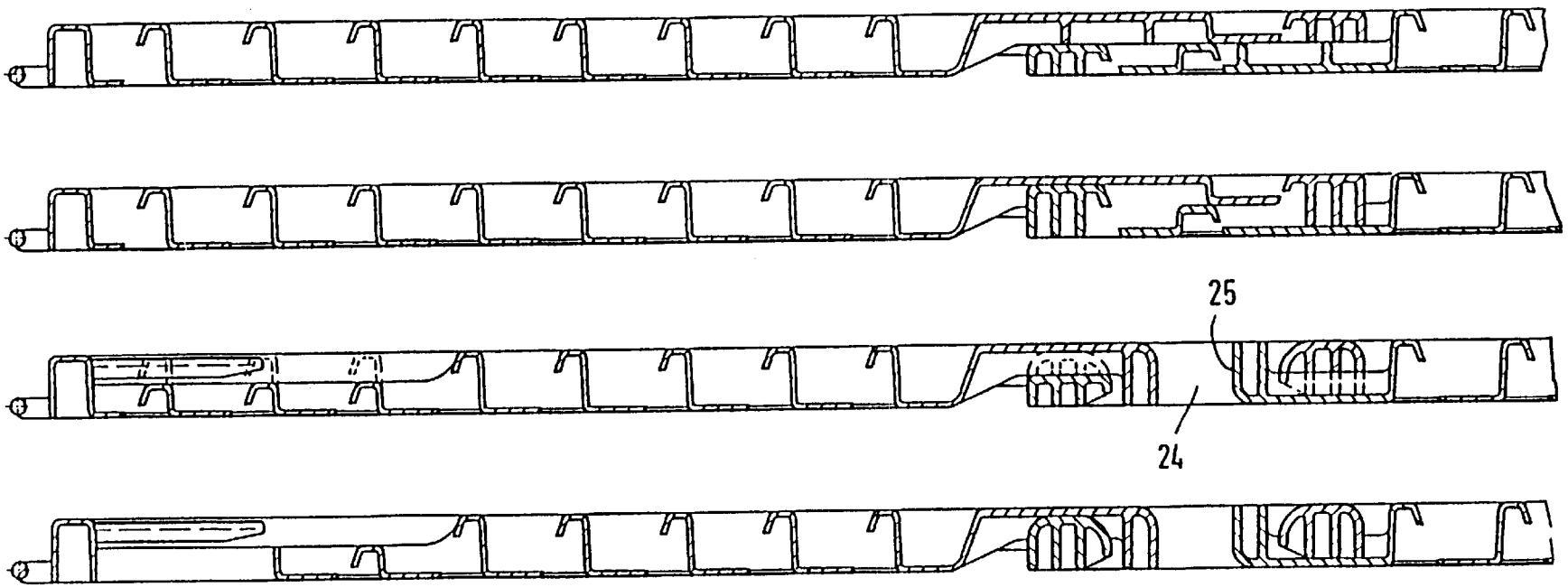

FIG. 18 shows various views of two short side walls in the position in which they interlock on top of one another in the folded position, whereby FIG. 19 illustrates the same sectional views of the side wall in a folded on top of one another position.

Thus it is evident that the upper edge section of the side walls, here the short side walls 1, are co-ordinated with one another in such a way by projections 24 and shoulders 25, that these side walls 1 fully interlock on top of one another in the collapsed position so that the height of the two collapsed side walls is only dictated by the single thickness of the side walls, as shown in the collapsed position represented in FIG. 19. This brings about an incredible height reduction of the container when the side walls are in their collapsed position. The length and height of the side walls can in this case be calculated in such a way that, for example, only the short side walls lock into one another as represented in the FIG. 19 or both long side walls or alternatively the long side walls 2 as well as the short side walls 1 interlock.

Figure 20:
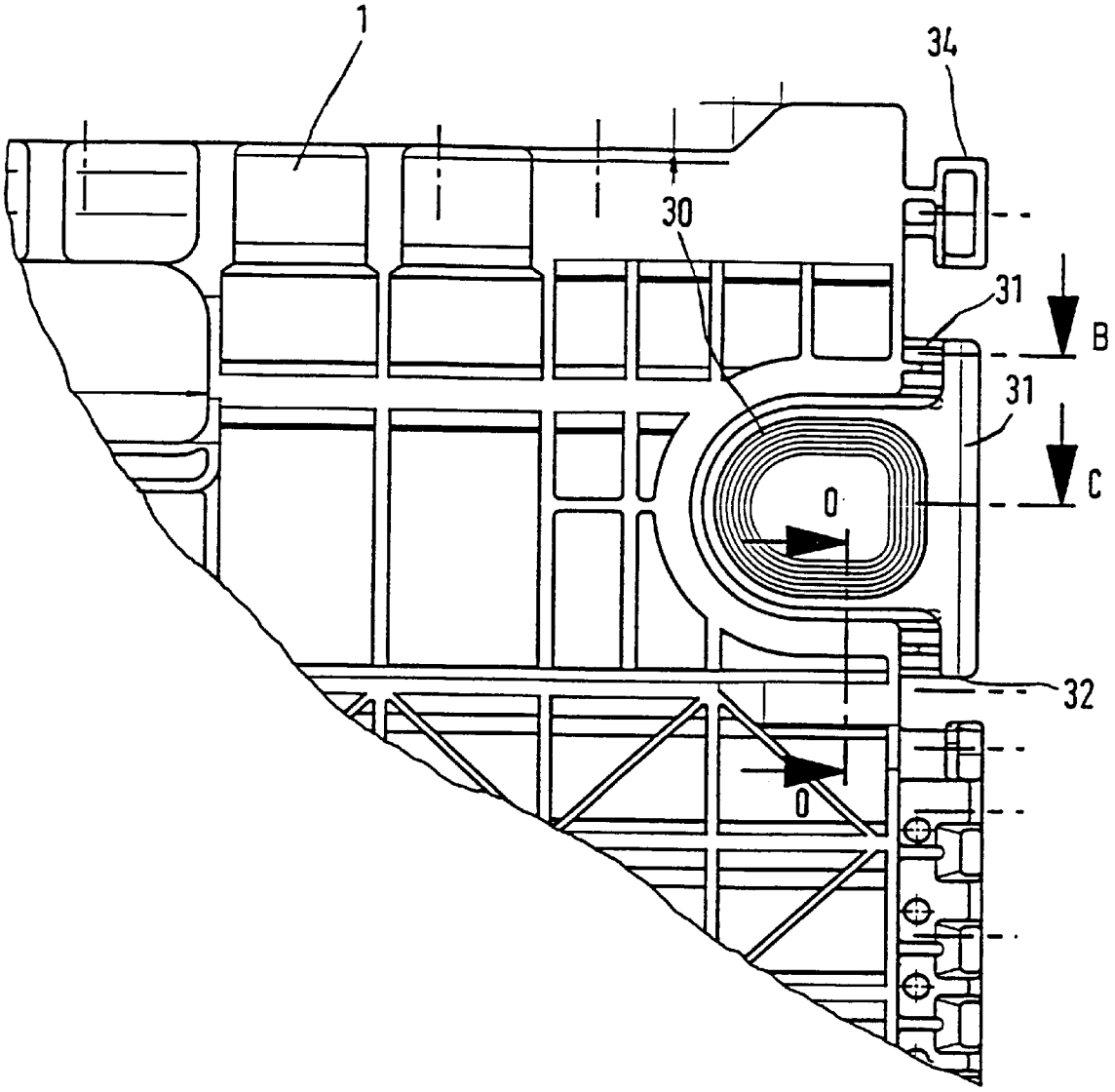
Figure 21:
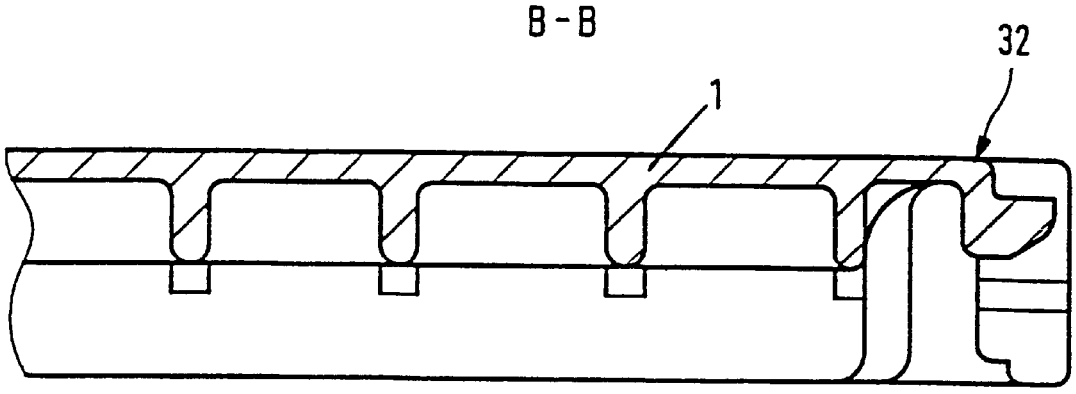
Figure 22:
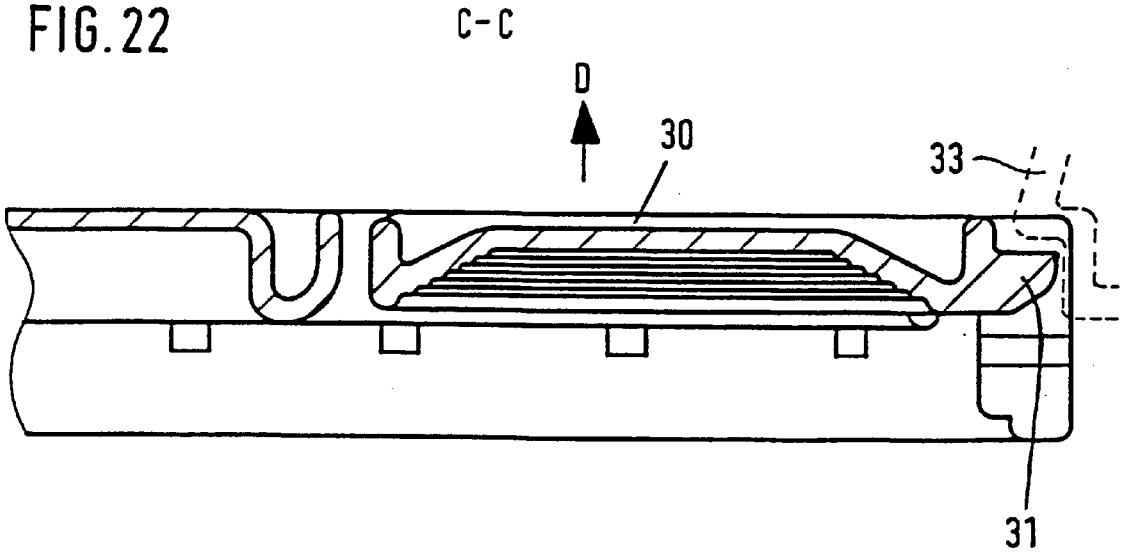

FIG. 20 shows a detailed view of the upper corner half of a short side wall to represent the locking mechanism with which the opened up side walls, here the short side wall with the long side wall, can be locked and unlocked. The corresponding sectional views of the section B and C are represented in the FIGS. 21 and 22.

Figure 2:
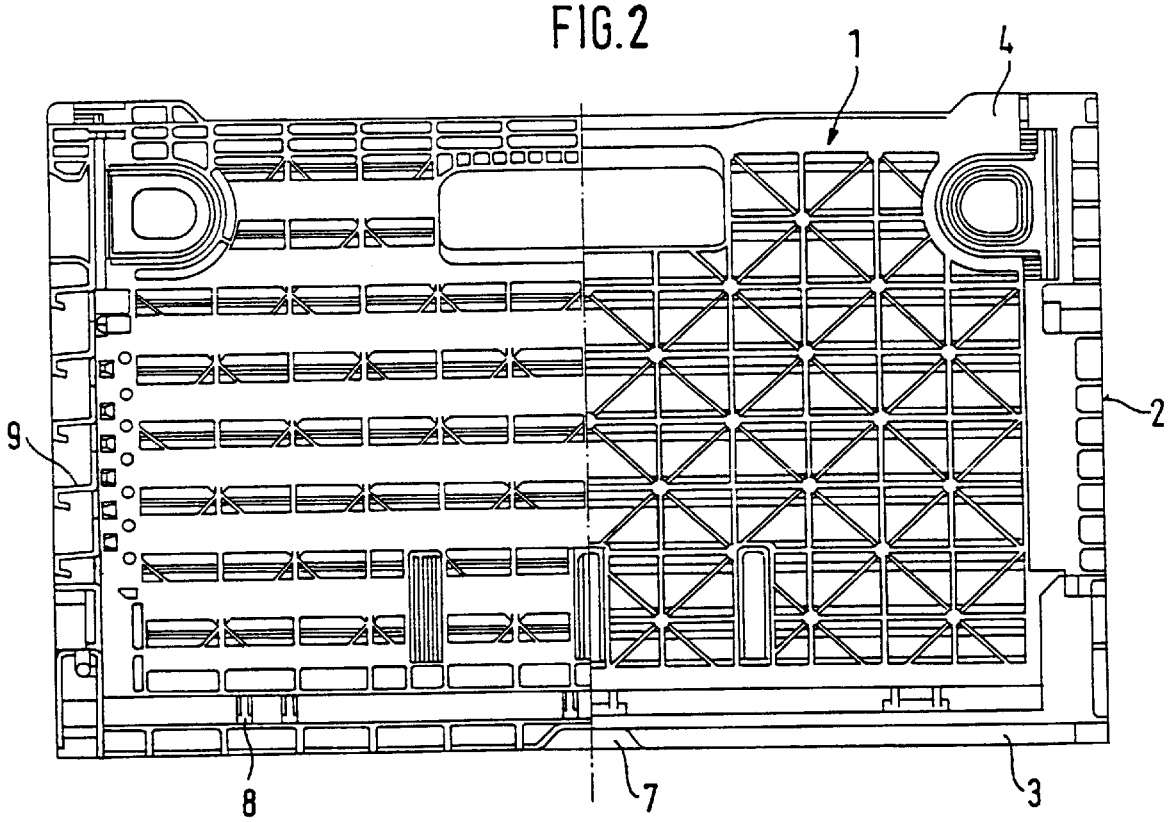
Figure 4:
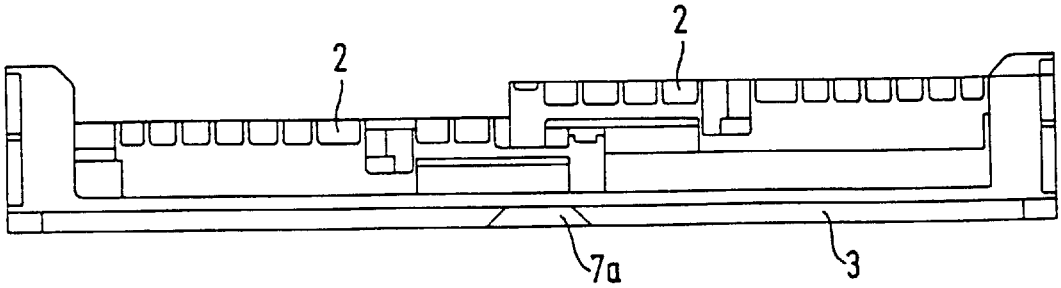
Figure 3:
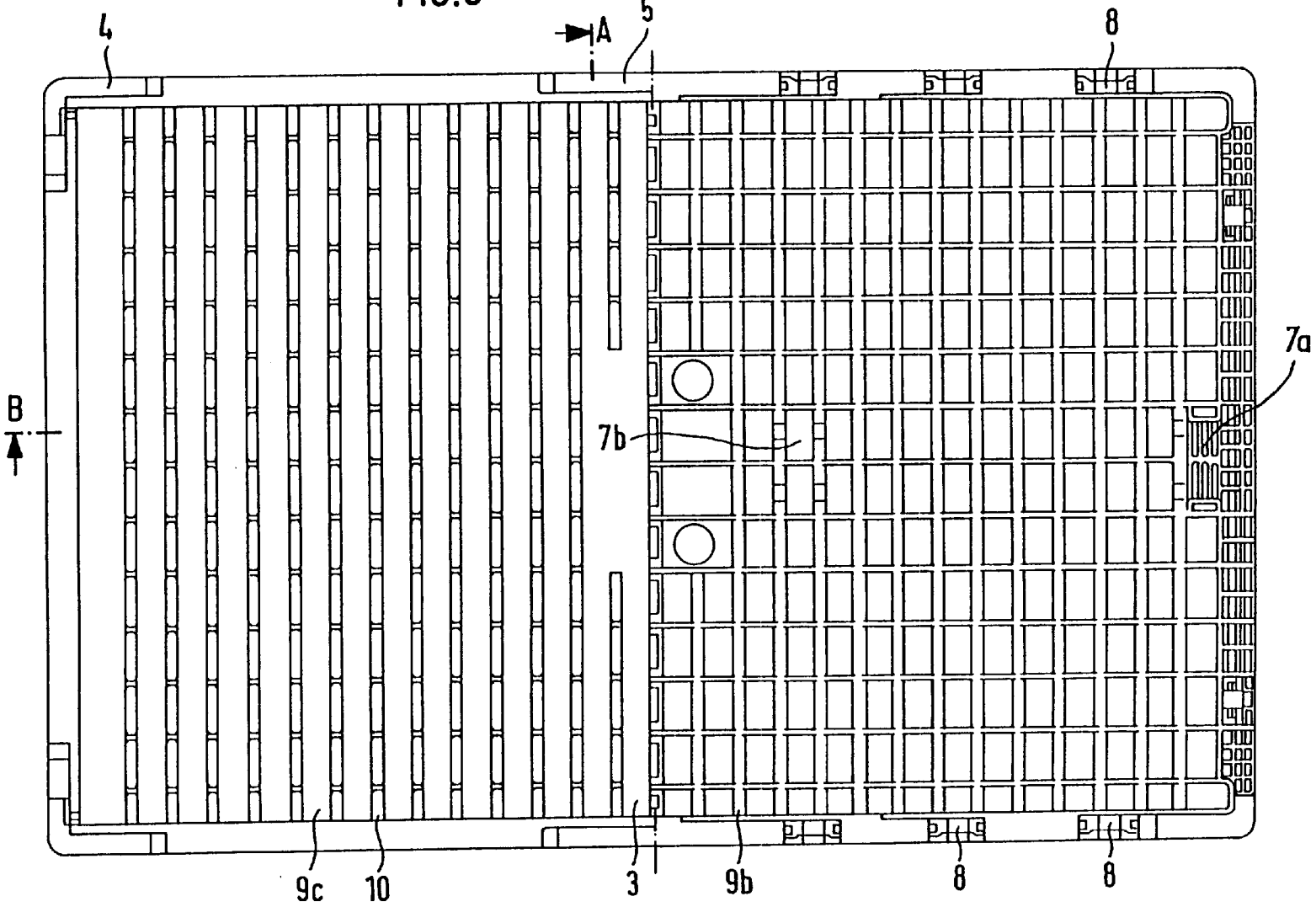

On this occasion a grip element is identified with 30, which is provided in the upper area of the short side wall on both sides corresponding to the representation in accordance with FIG. 2. This grip element 30 has a hook-like locking ledge 31, which is more or less hinged to the side wall 1, which corresponds to the representation in FIGS. 20 and 21 at 32, both above and below, corresponding to the representation in FIG. 20, whereby the joint-like connection is formed by a correspondingly reduced wall thickness of the side wall or at any rate the wall thickness can be shaped in order to form a lead-lag hinge. A corresponding counter part of the neighboring long side wall is identified with 33 and represented with a semicolon in FIG. 22, to ease explanation. When the short and long side walls are folded up, the locking ledge 31 latches behind a corresponding locking part 33 of the long side wall. To release, i.e. to fold the short side walls 1 inwards, the grip element 30 is pressed with the thumb and swung in the direction of the arrow D in such a way that the locking ledge 31 pivots around the two swing points 32 and therefore swings away from the locking part 33 of the long side wall thus enabling the short side walls to be folded inwards towards the base, as in FIG. 22. To improve the neck of the side walls in the folded up position, the tongues 34 (evident in FIG. 20) on the short side walls (resulting from FIG. 2) intervene with the corresponding shoulders 35 of the long side walls. This engagement point is not represented in FIG. 20, however the tongues 34 interact with the corresponding engagement parts on the long side walls in the folded up position. The release of the locking can take place only by applying thumb pressure to the grip elements 30 which is performed on both sides of the short side walls, so that the short side walls also fold inwards at the same time as the unlocking takes place. The grip elements can either be allocated on the short side walls or on the long side walls, depending on the configuration of the container.

While various embodiments of the present invention have been described in detail, it is apparent that modifications and adaptations of those embodiments will occur to those skilled in the art. It is to be expressly understood, however, that such modifications and adaptations are within the spirit and scope of the present invention as set forth in the following claims.

What is claimed is:

1. A container for the transportation of fruit and vegetables, comprising a container base, having four side walls, a circumference and having openings corresponding to hinge formations present on at least one of said side walls which has an edge, said four side walls can be folded onto the container base and are thereby characterized as being hinged by way of hinges and being foldable to said base, said hinges being formed as lockable connectors, said side walls being insertable and, by way of stop elements, being lockable with said hinges, wherein said stop elements comprise stop springs or latches capable of reaching into said openings at intervals along said base circumference, and said side walls being locked to said base by pin-type hinge forms, wherein each of said pin-type hinge forms is formed from two cross members having a diagonally running and lateral hinge pin over one of said cross members, whereby laterally protruding appendixes catch behind a shoulder and said hinge pin fits to a base-fixed counter part which forms a hinge bushing for the acceptance of said hinge pin, wherein said hinge pin has at least one protruding latch provided diagonally to an axle direction of said hinge pin which, in an opened up side wall position, interacts with at least one of a plurality of formed stop shoulders provided in an insert opening for said hinge and which forms a mechanical block for said side walls when erected.

2. The container according to claim 1 wherein two of said stop springs practically opposite to each other are provided in each opening and each of said hinges is formed from two cross members having a diagonally running and lateral hinge pin over one of said cross members, whereby laterally protruding appendixes catch behind said stop springs and said hinge pin fits to a base-fixed counter part which forms a hinge bushing for the acceptance of said hinge pin.

* * * * *